US005235763A

United States Patent [19]

Nosler et al.

[11] Patent Number: 5,235,763

[45] Date of Patent: Aug. 17, 1993

[54] KEY-ACTUATED SAFETY FOR HANDGUN

[75] Inventors: Robert A. Nosler; William L. Lewis, both of Bend, Oreg.

[73] Assignee: Nosler, Inc., Bend, Oreg.

[21] Appl. No.: 873,871

[22] Filed: Apr. 16, 1992

Related U.S. Application Data

[63] Continuation of Ser. No. 764,133, Sep. 20, 1991, abandoned.

[51] Int. Cl.[5] ..... F41A 17/02

[52] U.S. Cl. ..... 42/70.11; 42/66

[58] Field of Search ..... 42/70.11, 66

[56] References Cited

U.S. PATENT DOCUMENTS

| | | | |
|---|---|---|---|
| 774,712 | 11/1904 | Vold | 42/66 |
| 2,945,316 | 7/1960 | Mulno | 42/70.01 |
| 2,994,981 | 8/1961 | Carrigan | 42/66 |
| 3,462,869 | 8/1969 | Wallace | 42/70.11 |
| 3,553,877 | 1/1971 | Welch et al. | 42/70.01 |
| 3,882,622 | 5/1975 | Perlotto | 42/70.11 |
| 4,136,475 | 1/1979 | Centille | 42/70.11 |
| 4,261,127 | 4/1981 | Karkkainen | 42/70.11 |
| 4,563,827 | 1/1986 | Heltzel | 42/70.01 |
| 4,644,768 | 2/1987 | Nowak et al. | 70/492 |
| 4,763,431 | 8/1988 | Allan et al. | 42/70.11 |

*Primary Examiner*—Charles T. Jordan

*Attorney, Agent, or Firm*—Klarquist, Sparkman, Campbell, Leigh & Whinston

[57] ABSTRACT

A key actuated safety mechanism is described for mounting in the hand grip of a revolver or other hand gun. The safety mechanism includes a rotary operator having an eccentric projection which upon rotation to a locked portion directly engages the hand gun firing mechanism as a stop to prevent firing, or is coupled to such firing mechanism by a lock bar which acts as the stop. An improved key actuated rotary lock for use with such safety mechanism is also described having a cam actuated, spring biased plunger operated by the key inserted into an opening through such plunger for enabling the lock to be rotated between locked and unlocked positions.

7 Claims, 6 Drawing Sheets

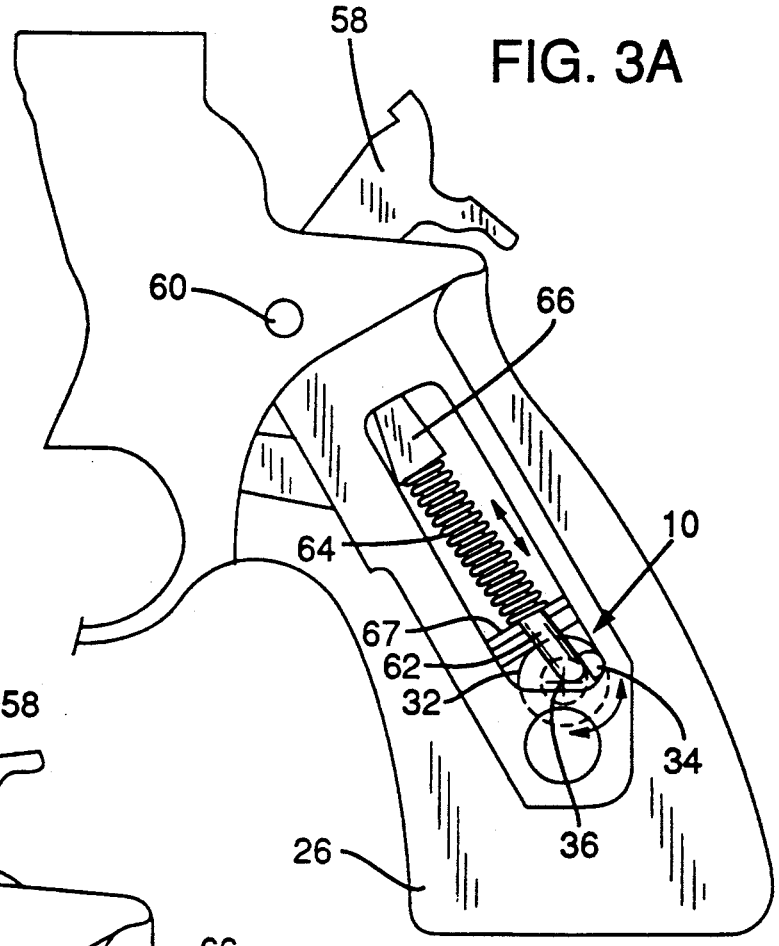
FIG. 3A
FIG. 3B
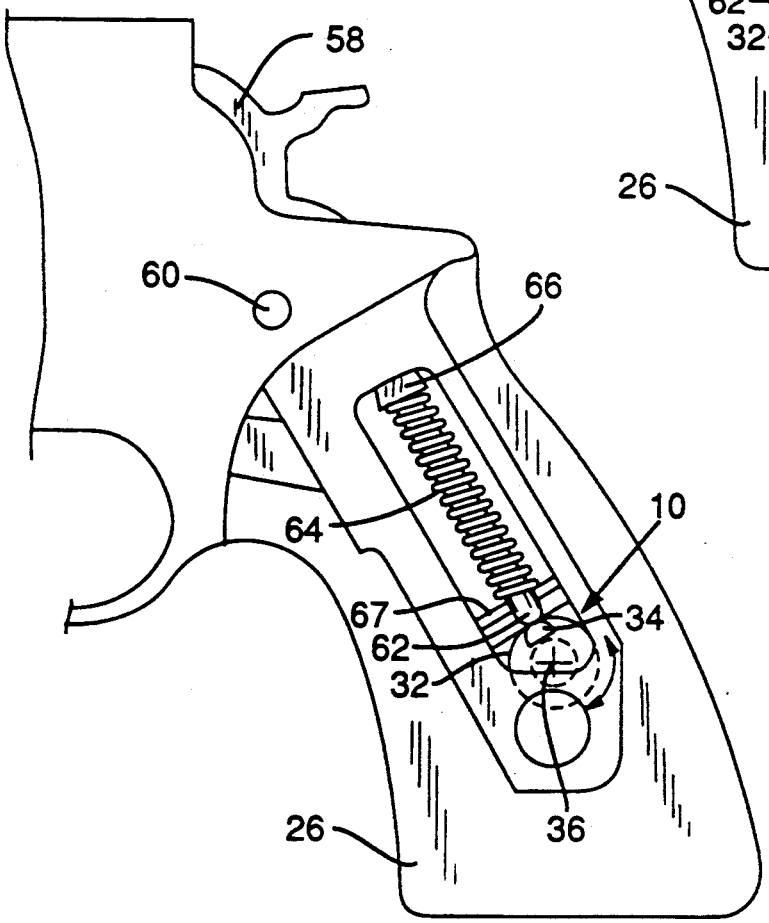

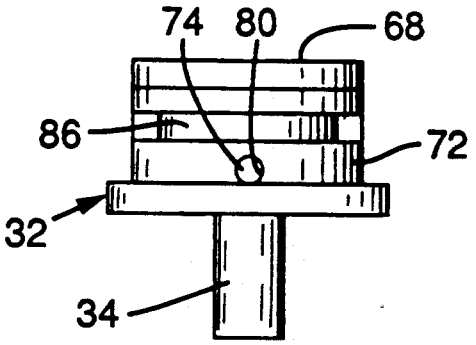
FIG. 6
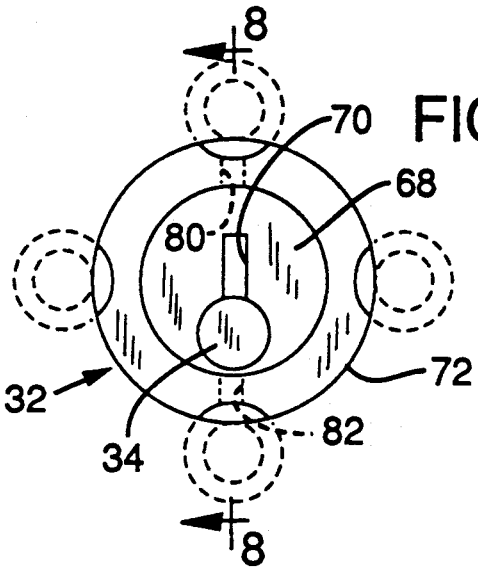
FIG. 5
FIG. 7
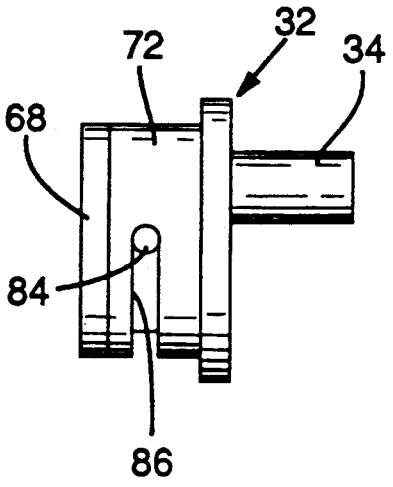
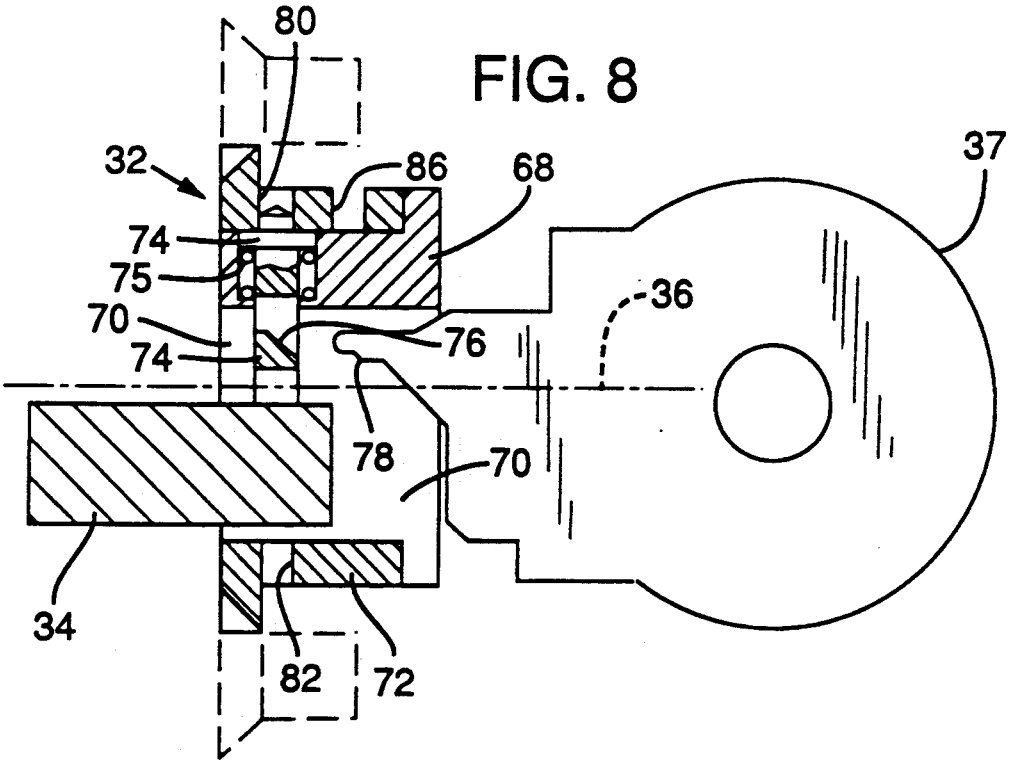
FIG. 8

KEY-ACTUATED SAFETY FOR HANDGUN

This application is a continuation of application Ser. No. 07/764,133 filed on Sep. 20, 1991, now abandoned.

The present invention relates generally to safety devices for firearms and in particular to key-actuated safety mechanisms for revolvers and other handguns, which are mounted in the hand grip of such handguns. The key-actuated safety mechanism of the present invention is simple and compact so that it may be retrofitted into conventional handguns by mounting in the hand grip of such handguns. Such safety mechanism includes a rotary operator means having an eccentric projection which directly engages the handgun firing mechanism or is coupled thereto by a lock bar operated by rotation of such projection. The key-actuated safety mechanism of the present invention is especially useful to prevent the accidental firing of handguns by children and other unauthorized persons.

BACKGROUND OF THE INVENTION

It has been previously proposed to provide key-actuated safety mechanisms for rifles and shotguns, as shown in U.S. Pat. No. 3,553,877 of Welch et al., issued Jan. 12, 1971, and U.S. Pat. No. 4,261,127 of Karkkainen, issued Apr. 14, 1981. However, such safety mechanisms are too complicated and bulky for use in the hand grips of handguns.

It has also been previously proposed to provide key-actuated locks for safety mechanisms in handguns, as shown in U.S. Pat. No. 2,945,316 of Mulno, issued Jul. 19, 1960, and U.S. Pat. No. 4,136,475 of Centille, issued Jan. 4, 1979. However, in both of these prior apparatus, a worm gear or a rack-and-pinion gear is operated by the key-actuated lock for operation of the safety mechanism, which is complicated and expensive. Also, such gear type safety mechanisms are operated by a lock extending through the bottom end of the hand grip, which takes up too much room. In the case of the Mulno patent, his worm gear safety mechanism may be also employed for shotgun or semi-automatic rifle extending through the side of the main frame.

A combination lock has been proposed for operating a safety mechanism in a handgun, as shown in U.S. Pat. No. 774,712 of Vold, issued Nov. 8, 1904. However, this does not have the simplicity and convenience of a key-actuated lock and is not mounted in the hand grip of such revolver, apparently due to the complicated nature of such combination lock-actuated safety mechanism.

More recent attempts to provide key-actuated safety mechanisms for revolvers are shown in U.S. Pat. No. 2,994,981 of Carrigan, issued Aug. 8, 1961, and U.S. Pat. No. 3,462,869 of Wallace, issued Aug. 26, 1969. The safety mechanisms of these patents, are mounted in the hand grip. However, in the case of the Carrigan patent, a rigid, elongated locking pin or finger is fixed to a rotating sleeve of a tumbler-type lock barrel for rotation therewith into and out of direct engagement with a shoulder on the hammer of the gun. Due to the nature of the rigid, elongated locking pin or finger, it can be bent or damaged when locked by forcing the hammer downward manually toward a cocked position. The key-actuated safety mechanism of the Wallace patent employs a lock cylinder which extends through an opening in the hammer and moves from a locked position where the hammer is engaged by a latch in the lock cylinder to an unlocked position where the latch is retracted and the lock cylinder extends outward from the side of the gun. However, this has a disadvantage in that when the gun is unlocked the lock cylinder extends from the side of the gun so that it may interfere with proper gripping of the gun. Also, since the locking mechanism is not mounted on the hand grip, it cannot be retrofitted on existing handguns.

Another key-actuated safety mechanism for a handgun is shown in U.S. Pat. No. 3,882,622 of Perloto, issued May 13, 1975, which is suitable for mounting in the side of an automatic pistol, but cannot be mounted on the hand grip of a revolver, in the manner of the present invention. In addition, this patent shows a somewhat complicated safety mechanism employing a cam which is rotated by the key actuator into engagement with a cam follower plunger in order to lock and unlock the safety mechanism.

SUMMARY OF THE INVENTION

It is therefore one object of the present invention to provide a key-actuated safety mechanism for a handgun, of simple and compact construction, which may be mounted on the hand grip of such gun for preventing such handguns from being accidentally discharged by children or other unauthorized persons.

Another object of the present invention is to provide such a safety mechanism which can be retrofitted on the hand grips of existing handguns.

A further object of the present invention is to provide such a safety mechanism for handguns, which is locked and unlocked by a conventional rotary lock mechanism which does not interfere with the normal operation of the handgun or prevent proper gripping of the hand grip of such gun.

An additional object of the present invention is to provide such a key actuated safety mechanism for a revolver handgun, which is easy to install on the hand grip of such gun and is of simple and reliable operation.

Still another object of the present invention is to provide such a safety mechanism employing few parts which includes a rotary operator means for operating the safety mechanism directly in response to rotation of a key-actuated lock.

A still further object of the present invention is to provide such a safety mechanism in which the rotary operator means includes an eccentric projection which directly engages the handgun firing mechanism or is coupled thereto by a lock bar operated by rotation of such projection.

DESCRIPTION OF DRAWINGS

Other objects and advantages of the present invention will be apparent from the following detailed description of certain preferred embodiments thereof, and from the attached drawings of which:

FIG. 3A is a side elevation view of a third type of revolver handgun with a third type of locking mechanism shown in the unlocked position with a portion of the hand grip broken away;

FIG. 3B is a side elevation view similar to that of FIG. 3A, except that the safety mechanism is shown in the locked position;

FIG. 5 is a rear elevation view of a key-actuated rotary lock which can be used in the safety mechanism;

FIG. 6 is a top plan view of the lock of FIG. 5;

FIG. 7 is a side elevation view of the lock of FIGS. 5 and 6; and

FIG. 8 is an enlarged vertical section view taken along the line 8—8 of FIG. 5.

DESCRIPTION OF PREFERRED EMBODIMENTS

Figure 1A:
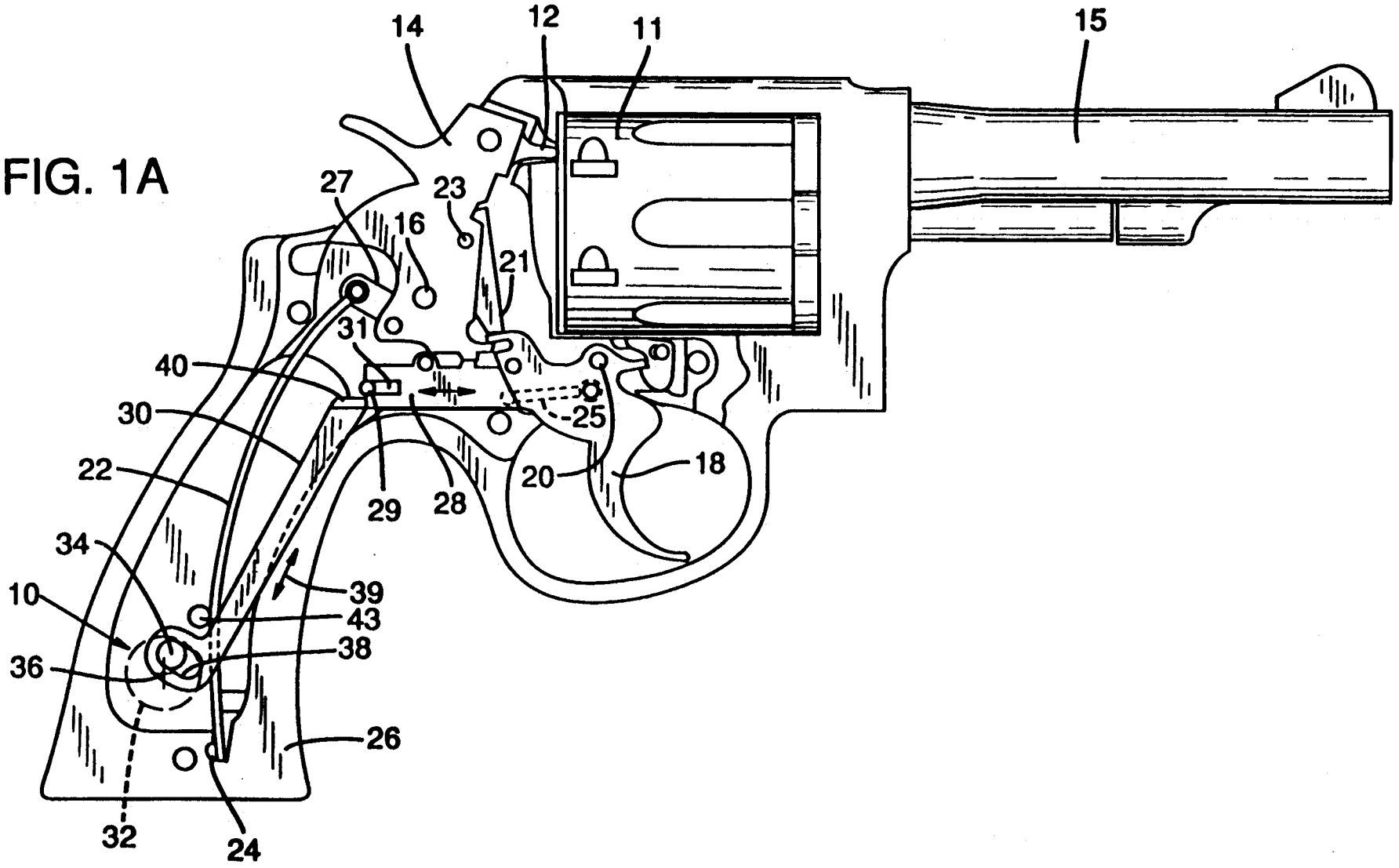
FIG. 1A is a side elevation view of one type of a revolver handgun with the hand grip and a portion of the frame broken away to show the operation of the safety mechanism in accordance with one embodiment of the present invention in a locked position.
Figures 1B, 1C:
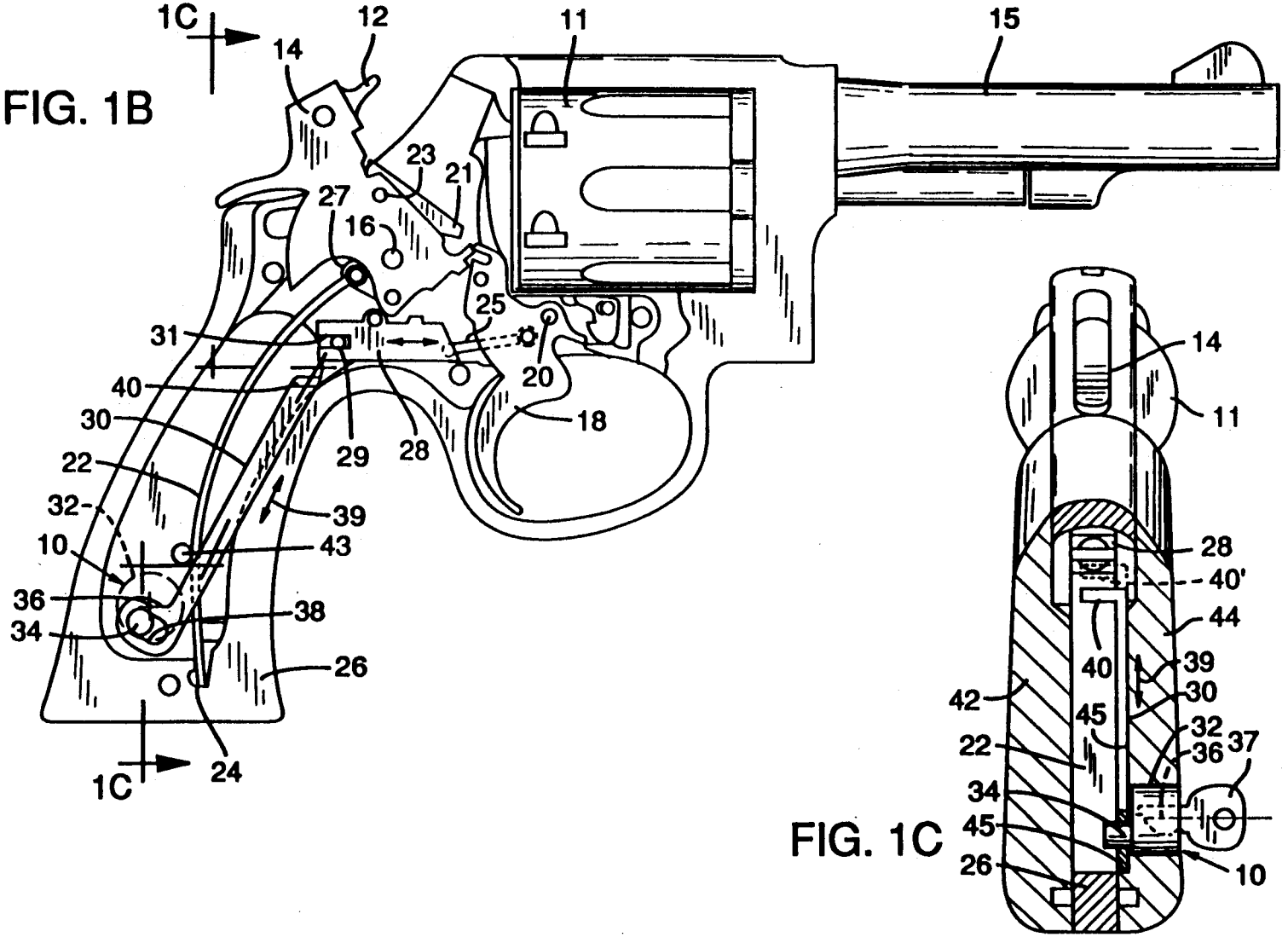
FIG. 1B is a side elevation view similar to that of FIG. 1A, but showing the safety mechanism in an unlocked position.
FIG. 1C is a section view taken along the line 1C—1C of FIG. 18 showing such safety mechanism with the lock bar in an unlocked position, shown in solid lines, and a locked position, shown in dashed lines.

As shown in FIGS. 1A, 1B, and 1C, a conventional revolver handgun such as a double-action Smith and Wesson type revolver, is provided with a key-actuated safety mechanism 10 in accordance with one embodiment of the present invention. The revolver includes a rotary cylinder 11 containing six circumferentially spaced cartridge chambers for holding bullet cartridges which are selectively rotated to the firing position where they are engaged by a firing pin 12 on a hammer 14 to shoot the bullet out of barrel 15 when the gun is fired. The hammer 14 pivots about a pivot pin 16 and is cocked either by moving the hammer back with the thumb, or by pulling the trigger 18 from the uncocked position of FIG. 1A to the cocked position of FIG. 1B. The trigger 18 pivots clockwise about a pivot pin 20 and engages a sear member 21 pivotally connected by a pivot 23 to the hammer 14 to cause them to both pivot counterclockwise about pivots 16 and 23, respectively. When the trigger is fully depressed into the firing position shown in FIG. 1B and removed from the sear 21, a mainsprinq 22, in the form of a leaf spring having one end fixedly mounted at slot 24 in the grip frame 26 and its other end pivotally connected to a hammer lever or stirrup 27 attached to the hammer 14, causes the hammer to rotate rapidly in a clockwise direction about pivot pin 16. This causes the firing pin 12 to strike the end of the cartridge located in the chamber at the firing position of the cylinder 11.

The movement of the trigger 18 from the uncocked position of FIG. 1A to the cocked position of FIG. 1B causes a spring-biased rebound slide 28 connected to the trigger by a coupling rod 25 pivotally attached at its opposite ends to move horizontally to the left along a guide pin 29 provided within a guide slot 31 in the left end of such slide. In order to prevent cocking of the revolver, the key-actuated safety mechanism 10 of the present invention slides a lock bar 30 upward into the path of rebound slide 28 in a locked position, as shown in FIG. 1A, to stop horizontal movement of the rebound slide. The key-actuated safety mechanism 10 includes a rotary key lock 32 having an operating projection 34 on one end thereof, which moves the lock bar 30. The rotary lock rotates about a central axis 36 and the operating projection 34 is spaced radially outward from such axis so that it acts as an eccentric stop or stop operator as in the case of the embodiment of FIGS. 1A, 1B, and 1C. Thus, the safety mechanism 10 is actuated by a key 37 turning the rotary lock 32 in a clockwise direction so that the operating projection 34 rotates from the unlocked position shown in FIG. 1B in a clockwise direction into the locked position shown in FIG. 1A. This causes the lock bar 30 to move upward from the unlocked position of FIG. 1B to the locked position of FIG. 1A which prevents horizontal sliding movement of the rebound slide 28 to the left. It should be noted that the lower end of the lock bar 30 is provided with an elongated slot 38 which permits sliding movement of the operating projection 34 in such slot during rotation of the rotary lock 32 to permit longitudinal sliding movement of the lock bar 30 in the direction of arrows 39 lateral to the axis of rotation 36 of the lock 32, into and out of the locked position shown in FIG. 1A.

As shown in FIG. 1C, the lock bar 30 is provided with a stop portion 40 extending laterally from the upper end of such lock bar so that such stop portion is in position to engage the left end of the rebound slide 28 in the raised, locked position 40', shown in dashed lines in FIG. 1C. Also, the lock bar 30 is mounted outside of the hand grip frame 26 so that it is spaced laterally from the mainspring 22 and does not interfere therewith. The hand grip frame 26 is provided with a pair of removable hand grip sides 42 and 44 which are fastened together on the opposite sides of such frame in a conventional manner by screws 43. Thus, in order to install the key-actuated safety mechanism 10 of the present invention, the right hand grip 44 is removed and drilled to accommodate the rotary lock 32 which is positioned so that the operating projection 34 extends into the hand grip cavity between the grip sides 42 and 44 in position to engage the slot 38 in the lower end of the lock bar 30. When engaged by the projection 34, the lock bar 30 slides longitudinally within a rectangular groove 45 on the inner surface of the grip side 44 beneath a portion of the edge of the grip frame 26 in the direction of the arrows 39 lateral to the axis of rotation 36 of the lock 32, as shown in FIGS. 1A to 1C. As a result of this simple and compact construction the key-actuated safety mechanism of the present invention may be retrofitted in the hand grips of conventional revolver handguns of the Smith and Wesson type.

Figure 2A:
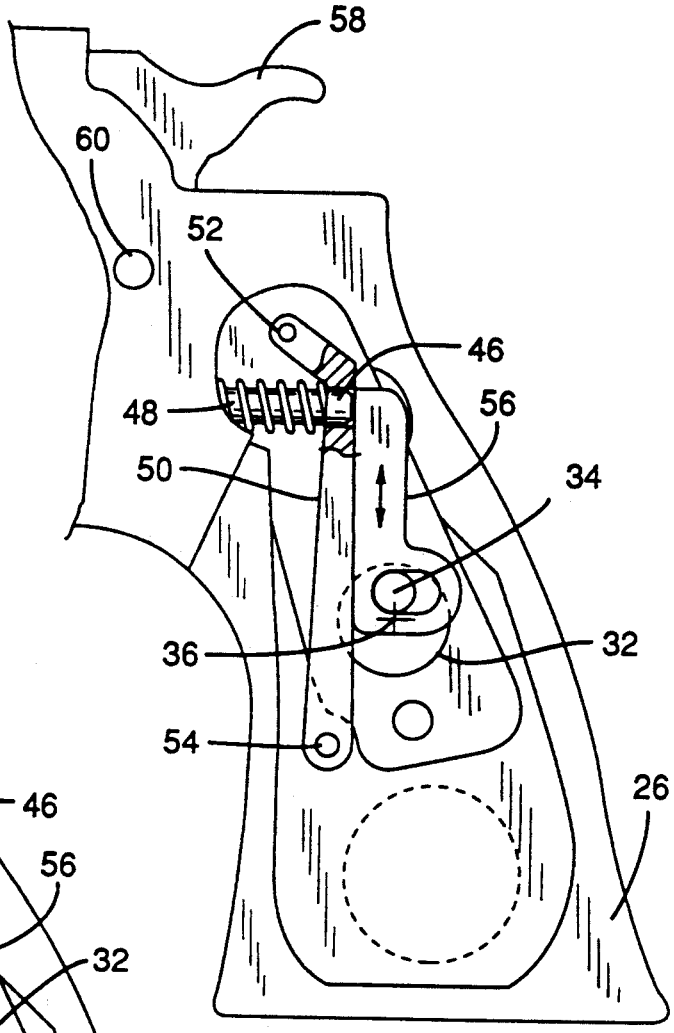
FIG. 2A is a side elevation view of another type of revolver handgun with the hand grip broken away to show another type of safety mechanism in its locked position.
Figure 2B:
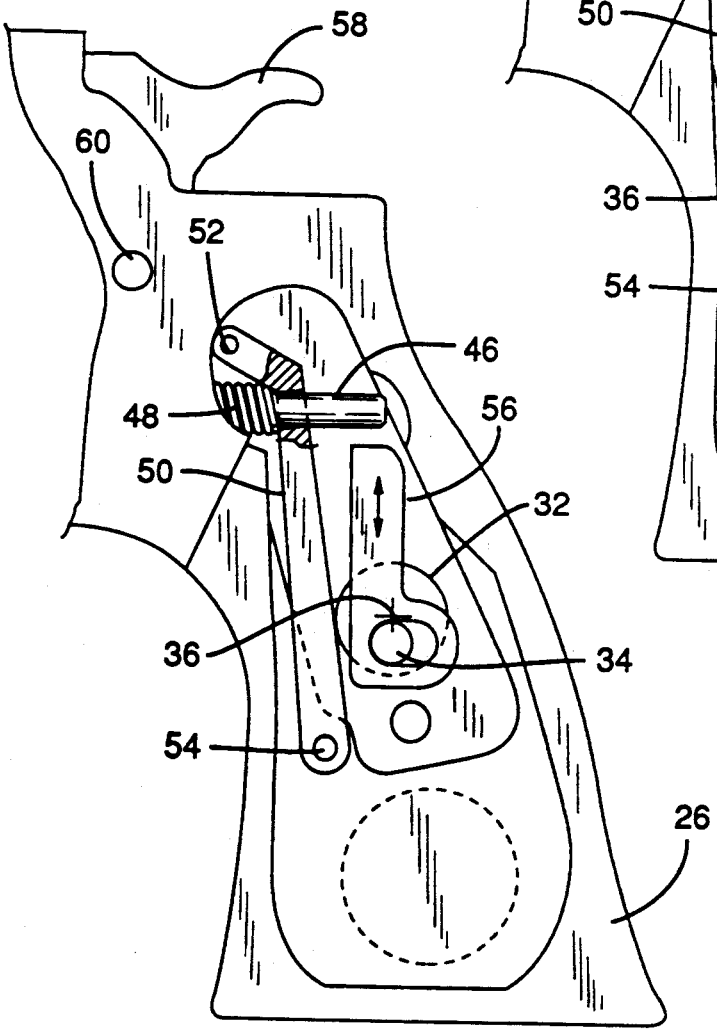
FIG. 2B is a side elevation view with parts broken away similar to FIG. 2A, but showing the safety mechanism in an unlocked position.

A second embodiment of the key-actuated safety mechanism 10 of the present invention is shown in FIGS. 2A and 2B, installed on a Ruger Red Hawk model revolver which is a double-action revolver that is cocked by use of the trigger or by moving the hammer backwards manually in a manner similar to that of the revolver of FIGS. 1A, 1B, and 1C. This revolver has a mainspring strut rod 46 surrounded by a coiled mainspring 48 which is part of the firing mechanism of such revolver. The firing mechanism also includes a hammer bar 50 which is pivotally attached at its upper end by pivot pin 52 to a hammer member 58 and is pivotally attached at its lower end by pivot pin 54 fixed to the hand grip frame 26. As shown in FIG. 2B, when the hammer is cocked the mainspring strut is moved longitudinally through the hammer bar 50 and mainspring 48 is compressed against the hammer bar 50. Thus, the mainspring strut 46 extends through the hammer bar 50 in the cocked position and protrudes horizontally to the right of the hammer bar.

The key-actuated safety mechanism 10 includes a lock bar 56 which is moved upward by the eccentric operator projection 34 on the rotary lock 32 into the raised locked position, shown in FIG. 2A, where such lock bar is in the path of the mainspring strut 46 adjacent the right end of such strut and acts as a stop to prevent it from moving to the right into the cocked position of FIG. 2B. Thus the lock bar 56 is operated by the projection 34 which is radially spaced from the axis 36 of the rotary lock 32 and rotates eccentrically about such axis when such rotary lock is rotated from the unlocked position of FIG. 2B to the lock position shown in FIG. 2A. The lower end of the lock bar 56 is provided with a slot 38 for accommodating movement of the eccentric operator projection 34 on the rotary lock 32 in a similar manner to the safety mechanism of FIGS. 1A, 1B, and 1C. The hammer bar 50 is pivotally connected at pivot pin 52 to a stirrup coupling (not shown) which is attached to the hammer 58 to cause it to pivot about pivot pin 60. Thus, in the cocked position of FIG. 2B, pulling the trigger of the revolver releases the hammer 58 and allows the mainspring 48 to rotate the hammer bar 50 in a clockwise direction about pivot pin 54 moving such hammer bar into the position of FIG. 2A which rotates the hammer 58 about pivot pin 60 in a counterclockwise direction causing the revolver to fire. The remainder of the revolver is conventional and, therefore, is not shown in FIGS. 2A and 2B.

A third embodiment of the key-actuated safety mechanism 10, used in a Ruger Model No. GP-100 revolver, is shown in FIGS. 3A and 3B. This revolver employs a hammer strut 62 which is surrounded by a mainspring 64 and moves longitudinally for operating the firing mechanism. The hammer strut 62 is connected at its upper end to a coupling 66 which is pivotally coupled to the hammer 58 for pivoting such hammer about pivot pin 60 from the cocked position of FIG. 3A in a counterclockwise direction into the uncocked position of FIG. 3B due to the force of the compressed mainspring causing the gun to fire. The hammer strut 62 extends through a spring seat member 67 in the form of a washer having a central opening of a size which allows the hammer strut to pass but prevents the mainspring 64 from passing therethrough. Thus, the mainspring is compressed when the hammer strut 62 is moved longitudinally downward from the uncocked position of FIG. 3B into the cocked position of 3A. As a result, when the trigger is pulled to release the hammer 58 such hammer is driven into a firing position by upward movement of the hammer strut in response to the expansion of the mainspring 64.

In order to lock the safety of the handgun and prevent firing the key-actuated safety mechanism 10 is rotated from the unlocked position of FIG. 3A to the locked position of FIG. 3B. Such safety mechanism includes an eccentric operating projection 34 on the rotary lock cylinder 32 which is rotated counterclockwise 90 degrees about the axis 36 of such lock cylinder by the key. When the safety is locked such operating projection acts as a stop to prevent the hammer strut 62 from being extended down from the uncocked position in FIG. 3B.

In order to unlock the key-actuated safety mechanism, the rotary lock 32 is rotated clockwise 90 degrees from the locked position shown in FIG. 3B to the unlocked position shown in FIG. 3A. In the unlocked position of 3A the eccentric stop 34 is positioned out of the path of the hammer strut 62 thereby allowing such hammer strut to extend longitudinally downward thereby causing the mainspring 64 to be compressed against the spring seat 68. Thus, it can be seen that by an extremely simple and compact key-actuated rotary lock and eccentric operator projection a safety mechanism is provided which may be installed in the hand grip of the revolver merely by drilling a hole through one of the side hand grips attached to the hand grip frame 26 of such revolver. This is done in a similar manner to that shown in FIG. 1C except that the need for the lock bar 30 is eliminated and the operating projection 34 of the lock operates directly as a stop on the hammer strut 62 to prevent firing of the revolver.

Figure 4A:
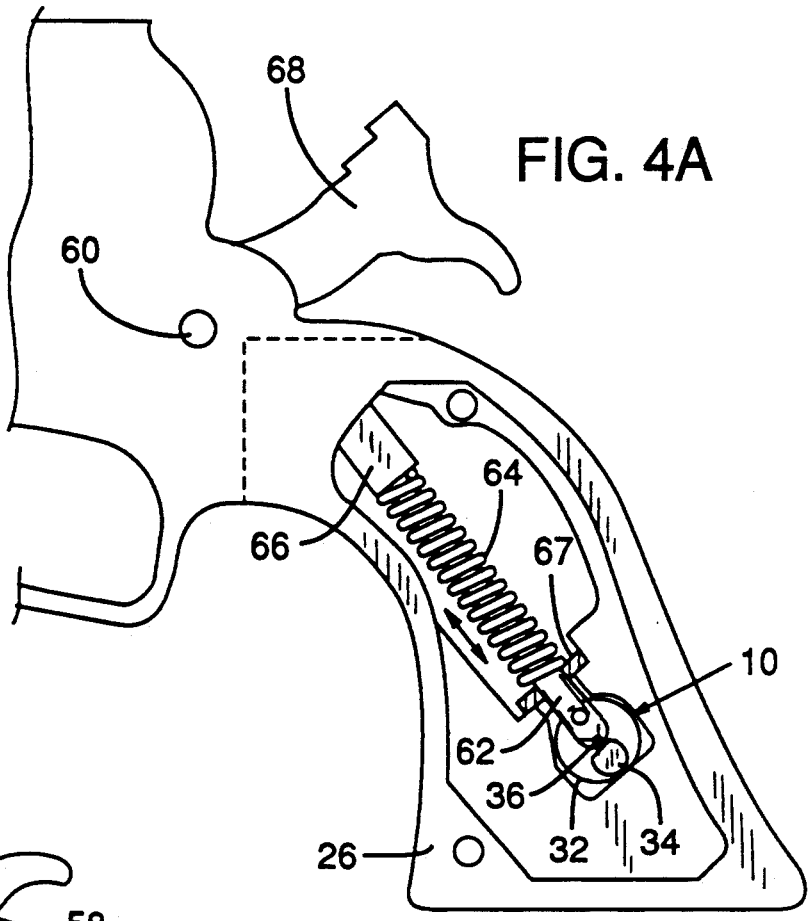
FIG. 4A is a side elevation view of a fourth type of revolver handgun with the hand grip broken away to show a fourth type of safety mechanism, in accordance with the present invention, in its unlocked position.
Figure 4B:
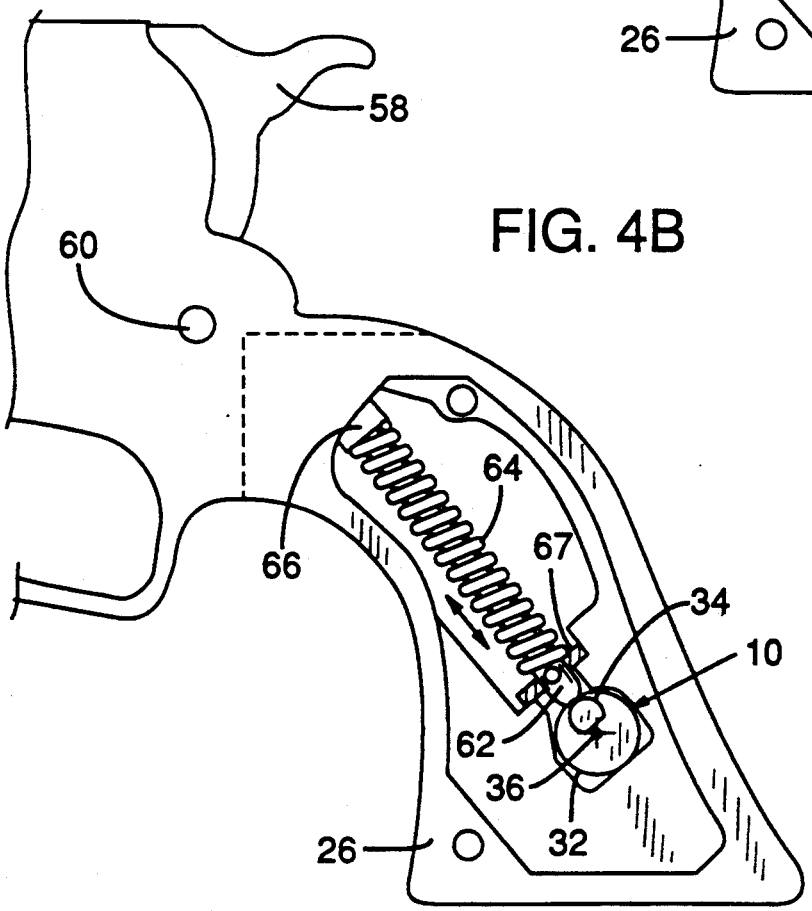
FIG. 4B is a side elevation view similar to that of FIG. 4A, but showing the safety mechanism in a locked position.

A fourth embodiment of a revolver handgun having the key-actuated safety mechanism 10 of the present invention is shown in FIGS. 4A and 4B, which is a single action revolver such as a Ruger Blackhawk. With this revolver the hammer 58 must be cocked by the thumb by rotating the hammer 58 about the pivot pin 60 into the cocked position of FIG. 4A. The firing mechanism of this revolver is similar to that of FIGS. 3A and 3B so that only the differences between the safety mechanisms of these two revolvers will be described with respect to the revolver of FIGS. 4A and 4B. Thus, the safety mechanism 10 of this revolver also includes a rotary key-actuated lock 32 which rotates 180 degrees between the unlocked position of FIG. 4A and the locked position of FIG. 4B. An eccentric operating projection 34 on the end of such lock is rotated in a counterclockwise direction from the unlocked position of FIG. 4A to the locked position of FIG. 4B where it operates as a stop. Thus, in the locked position of FIG. 4B, the operating projection 34 is in position to engage the lower end of the mainspring strut 62 to prevent longitudinal movement of such strut downward. This prevents the revolver from firing because the hammer 58 cannot be moved downward to the cocked position of FIG. 4A.

The rotary lock 32 is moved from the locked position of FIG. 4B to the unlocked position by insertion of the key and rotation of the lock 32 and operating projection 34 through 180 degrees in a clockwise direction. This allows the mainspring strut 62 to move longitudinally downward into the cocked position shown in FIG. 4A thereby compressing the mainspring 42. As a result, when the trigger is pulled and the hammer 58 released from the trigger member, the mainspring 64 urges the coupling member 66 upward thereby causing the hammer 58 to rotate rapidly in a counterclockwise direction about pivot pin 60 to fire the gun.

As shown in FIGS. 5, 6, 7 and 8, one type of key-actuated rotary lock 32 which can be employed in the safety mechanism of the present invention includes a rotary barrel member or tumbler 68 having a key slot 70 for insertion of the key 37 to turn such tumbler within a sleeve 72. A spring biased plunger 74 is mounted with a spring 75 in the side of tumbler 68 and is provided with an inclined opening 76 in the side of such plunger. The key 37 has a corresponding ramp shaped end portion 78 which acts as a cam to engage the inclined opening 76 and cause the plunger 74 to be depressed inward of a first plunger hole 80 in the sleeve 72 to a retracted position corresponding to the unlocked position of the lock. Then the tumbler 68 can be rotated 90 or 180 degrees by the key 37 into the locked position where the plunger 74 is urged outward by spring 75 into a second plunger hole 82 in the sleeve when the key is removed from the slot 70. Of course, the eccentric projection 34 also rotates 180 degrees with the tumbler 68 to which it is attached in order to operate the safety mechanism. A retaining pin 84 fixed to the side of the tumbler 68 moves within a retaining slot 86 through the sleeve 72 to retain the tumbler in the sleeve during rotation. Of course, the length of slot 86 controls the angle of maximum rotation.

It will be obvious to those having ordinary skill in the art that many changes may be made in the above-described preferred embodiments of the present invention. Therefore, the scope of the present invention should be determined by the following claims.

I claim:

1. Handgun safety lock apparatus, comprising:

a handgun firing mechanism including a hammer;

safety means for preventing a handgun from firing;

key actuated lock means for moving said safety means in response to rotation of said lock means about an axis of rotation, between a locked position where the safety means is operated and an unlocked position where the safety means is disabled; and eccentric projection means which is rotated by said lock means to operate said safety means by engagement of said eccentric projection means with a member coupled to the firing mechanism of the gun.

2. A safety lock apparatus in accordance with claim 1 in which the handgun is a revolver and the safety means includes a rotary operator means provided by the eccentric projection means which engages a hammer strut to prevent cocking a hammer of the revolver.

3. A safety lock apparatus in accordance with claim 1 which also includes mounting means for mounting said lock means and said safety means in a hand grip portion of said hand gun.

4. A safety lock apparatus in accordance with claim 1 in which the projection means is positioned in said locked position to engage a hammer strut member connected to a hammer of the handgun to prevent the hammer from cocking.

5. A safety lock apparatus in accordance with claim 1 in which the safety means includes a longitudinal operator means provided by a lock bar and the projection means engages said lock bar to move the lock bar longitudinally into a locked position for engagement with a hammer strut of the handgun to prevent the hammer from cocking in said locked position.

6. A safety lock apparatus in accordance with claim 1 in which the handgun is a revolver and the safety means includes a longitudinal operator means provided a lock bar and the projection means engages said lock bar to move the lock bar longitudinally into a locked position for engagement with a rebound slide of the revolver to prevent the hammer from cocking in said locked position.

7. A safety lock apparatus in accordance with claim 1 in which the lock means is a rotary lock means having a cam actuated plunger rotating the eccentric projection means between a locked position and an unlocked position.

* * * * *